US006298608B1

(12) United States Patent
Alley

(10) Patent No.: US 6,298,608 B1
(45) Date of Patent: Oct. 9, 2001

(54) DEVICE TO SECURE SNOW GUARD BELOW SUBSTRATE LAYER OF ROOF

(76) Inventor: F. William Alley, Gebbie Rd., Greensboro, VT (US) 05841

( * ) Notice: Subject to any disclaimer, the term of this patent is extended or adjusted under 35 U.S.C. 154(b) by 0 days.

(21) Appl. No.: 09/243,383

(22) Filed: Feb. 1, 1999

(51) Int. Cl.[7] ..... E04D 13/076

(52) U.S. Cl. ..... 52/25; 52/24; 52/712; 52/714; 248/237; 248/207; 248/217.4

(58) Field of Search ..... 52/25, 24, 712, 52/714; 248/237, 207, 217.4; 256/12.5

(56) References Cited

U.S. PATENT DOCUMENTS

| | | | | |
|---|---|---|---|---|
| 1,925,263 | * | 9/1933 | Levow | 108/27 |
| 2,079,768 | * | 5/1937 | Levow | 108/27 |
| 5,092,088 | * | 3/1992 | Way | 52/25 |
| 5,609,326 | * | 3/1997 | Stearns et al. | 256/12.5 |
| 5,613,328 | * | 3/1997 | Alley | 52/25 |
| 5,732,513 | * | 3/1998 | Alley | 52/25 |
| 5,873,201 | * | 2/1999 | Fey | 52/27 |

* cited by examiner

*Primary Examiner*—Carl D. Friedman
*Assistant Examiner*—Christy M. Syres
(74) *Attorney, Agent, or Firm*—Clifford L. Tager

(57) ABSTRACT

The present invention can be attached to any type of roof which comprises an outer layer attached to a substrate layer. The present invention comprises a block having a base and a top, a snow guard attached to the block, and two rods, each having a first and a second terminal end and a predetermined length therebetween. The first terminal end of each rod is attached to the base of the block. To secure the block to the roof, two holes are placed through the outer and substrate layers of the roof. The base of the block is placed in juxtaposition with the outer layer of the roof, with the second terminal ends of the two rods located through the holes in the roof. The length of the two rods is sufficient to allow the second terminal ends thereof to extend below the substrate layer of the roof. A first and second securement device is located on the portion of the first and second rods, respectively, protruding from the substrate layer of the roof to secure the second terminal ends of the two rods below the substrate layer of the roof, thereby securing the block to the roof. A mounting bracket is optionally locatable between the base of the block and the outer layer of the roof, and a lock plate is optionally locatable between the substrate layer of the roof and the first and second securement devices.

49 Claims, 6 Drawing Sheets

DEVICE TO SECURE SNOW GUARD BELOW SUBSTRATE LAYER OF ROOF

BACKGROUND OF THE INVENTION

1. Technical Field

The present invention is directed to a device to secure a snow guard to a roof. More particularly, the roof comprises an outer layer attached to a substrate layer, and the present invention is directed to a device to secure the snow guard below the substrate layer of the roof.

2. Background Information

It is often desirable to secure a snow guard to the roof to prevent the snow and ice which accumulates on the roof from falling off, thereby potentially damaging persons and/or property located in the fall path of the snow and ice.

Roofs are well known in the art and include, for example, metal roofs, shingle roofs and membrane roofs. Roofs typically comprise an outer layer, such as metal panels, shingles or a rubber membrane, attached to a substrate layer, such as plywood or particle board.

In a metal roof, the outer layer typical comprises a plurality of metal panels, each running the length of the roof. The panels are laid side by side to cover the width of the roof, and the abutting panels are typically crimped together to form a water-resistant joint. Snow guards are typically attached to a metal roof by placing same over a portion of the joint and securing the snow guard to the joint, e.g., via set screws.

In a shingle roof, the outer layer typical comprises multiple rows of shingles placed in ascending fashion on the substrate layer, optionally with tar paper therebetween. Snow guards are typically attached to a shingled roof by placing same onto the outer layer of the shingles and driving screws through the snow guard into the substrate layer of the roof.

In a membrane roof, the outer layer typical comprises a rubber membrane which covers the substrate layer of the roof. Snow guards are typically attached to a membrane roof by securing a base of the snow guard to the substrate layer via screws, placing the membrane over the substrate layer and base of the snow guard, removing a portion of the membrane so that a portion of the base is exposed therethrough, and then securing an upper portion of the snow guard to the exposed portion of the base.

In areas which experience very heavy snow fall and/or ice buildup, an extreme load is often placed on the snow guard from the snow and ice which has accumulated on the roof. The load which is pressed against the snow guard creates a torque thereon, potentially causing the trailing edge of the snow guard to lift from the roof. When this occurs, the leading edge of the snow guard could cut into the outer layer of the roof, causing the roof to leak. Where the load on the snow guard is excessive, the snow guard could be torn from the roof.

SUMMARY OF THE INVENTION

Accordingly, the present invention is directed to a device to secure a snow guard to a roof, the device being attached to the roof to withstand substantial loads placed on the snow guard, thereby minimizing the possibility of the snow guard being torn from the roof.

The present invention can be attached to any type of roof, including but not limited to a metal roof, a shingle roof, a tar roof or a membrane roof. The roof preferably comprises an outer layer, such as metal panels, shingles, a layer of tar or a rubber membrane. The outer layer is preferably attached to a substrate layer, such as plywood or particle board.

In the preferred embodiment, the present invention comprises a block having a first and a second side wall, a base and a top, a snow guard operatively attached to the block, and two rods, each rod having a first and a second terminal end and a predetermined length therebetween. The first terminal end of each rod is operatively attached to the block, preferably to the base of the block.

In order to secure the block to the roof, two holes are drilled or otherwise made through the outer layer and substrate layer of the roof. The two holes are preferably located and of sufficient diameter to accommodate the two rods. The base of the block is placed in juxtaposition with the outer layer of the roof, with the second terminal ends of the two rods located through the holes in the roof.

The length of the two rods is preferably sufficient to allow the second terminal ends thereof to extend below the substrate layer of the roof.

The block is preferably secured to the roof via two securement devices. The first and second securement devices are located on the portion of the first and second rods, respectively, which extend below the substrate layer of the roof to secure the second terminal ends of the two rods below the substrate layer of the roof, thereby securing the block to the roof.

More particularly, the rods further comprise a threaded portion located near the second terminal ends thereof, and the securement devices comprise a structure having internal threads threadable about the threaded portion of the rods.

In another preferred embodiment, the second terminal ends of the rods do not extend below the substrate layer of the roof when the base of the block is located on the outer layer of the roof. Rather, the second terminal ends of the rods are located within the holes of the roof.

The block is secured to the roof via two securement devices. Each securement device preferably comprises a substantially tubular structure having a first and a second terminal end and an end cap secured to the first terminal end.

Internal threads are preferably located within at least a portion of the tubular structure. The second terminal end of each tubular structure is locatable within one of the holes of the roof, and a portion of the internal threads thereof are threadable about a portion of the threaded portion of the rod located therewithin.

The end cap of each securement device is located below the substrate layer, relative to the outer layer of the roof, when the base of the block is located in juxtaposition with the outer layer of the roof, thereby securing the block to the roof.

In both embodiments, a mounting bracket is optionally locatable between the base of the block and the outer layer of the roof when the base of the block is located in juxtaposition with the outer layer of the roof. Additionally, in both embodiments, a lock plate is optionally locatable between the substrate layer of the roof and the first and second securement devices.

DESCRIPTION OF THE PREFERRED EMBODIMENT(S)

The present invention is directed to a device to secure a snow guard to a roof, the device being attached to the roof to withstand substantial loads placed on the snow guard, thereby minimizing the possibility of the snow guard being torn from the roof.

Figure 1:
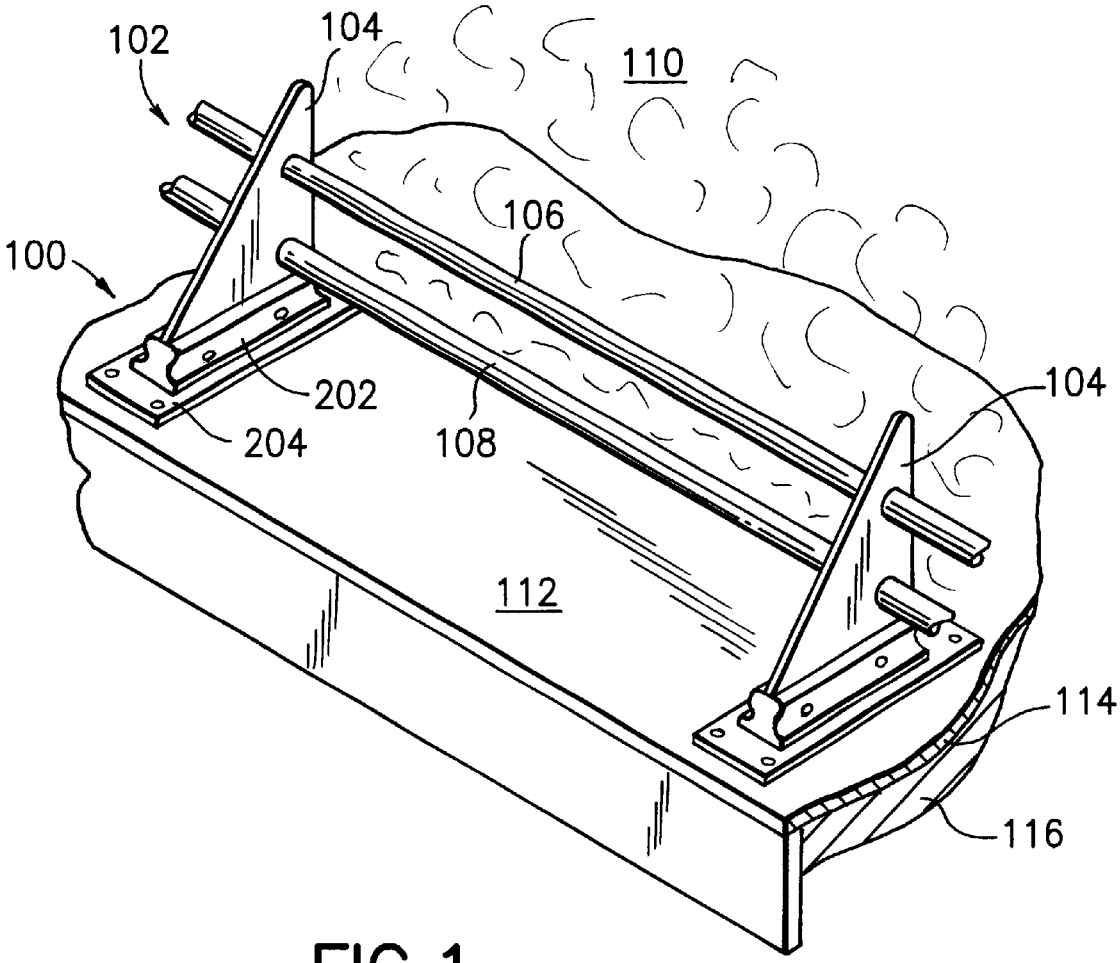
FIG. 1 is a isometric view of the present invention with snow guard attached to a roof.

Turning now to FIG. 1, the present invention 100 is shown attached to roof 112 with snow guard 102 attached thereto.

Snow guard 102 preferably comprises a plurality of brackets 104, each having holes located therein to allow pipes 106 and 108 to be placed therethrough. The pipes act as a fence to help prevent ice and/or snow 110 from falling off roof 112 and potentially damaging persons and property located in its fall path.

Each bracket 104 is preferably attached to the present invention via a groove or other suitable opening located in the top of block 202, and pipes 106 and 108 are preferably secured within brackets 104 of the snow guard via set screws, as described in detail with reference to US Pat. No. 5,613,328 to Alley, incorporated herein by reference.

Variations to the configuration of the snow guard, such as the number of pipes, shape of the brackets, method of securing the pipes within the brackets, method of attaching the brackets to the block and placement of the bracket with respect to the block, will be obvious to those skilled in the art.

The present invention can be attached to any type of roof, including but not limited to a metal roof, a shingle roof, a tar roof or a membrane roof. Roof 112 preferably comprises outer layer 114, such as metal panels, shingles, a layer of tar or a rubber membrane. The outer layer is preferably attached to substrate layer 116, such as plywood or particle board. Optionally, a layer of felt or tar paper (not shown) can be placed therebetween, as applicable building codes and/or weather conditions dictate.

The present invention is secured to the roof as hereinafter described with reference to FIGS. 2 through 9.

Figure 2:
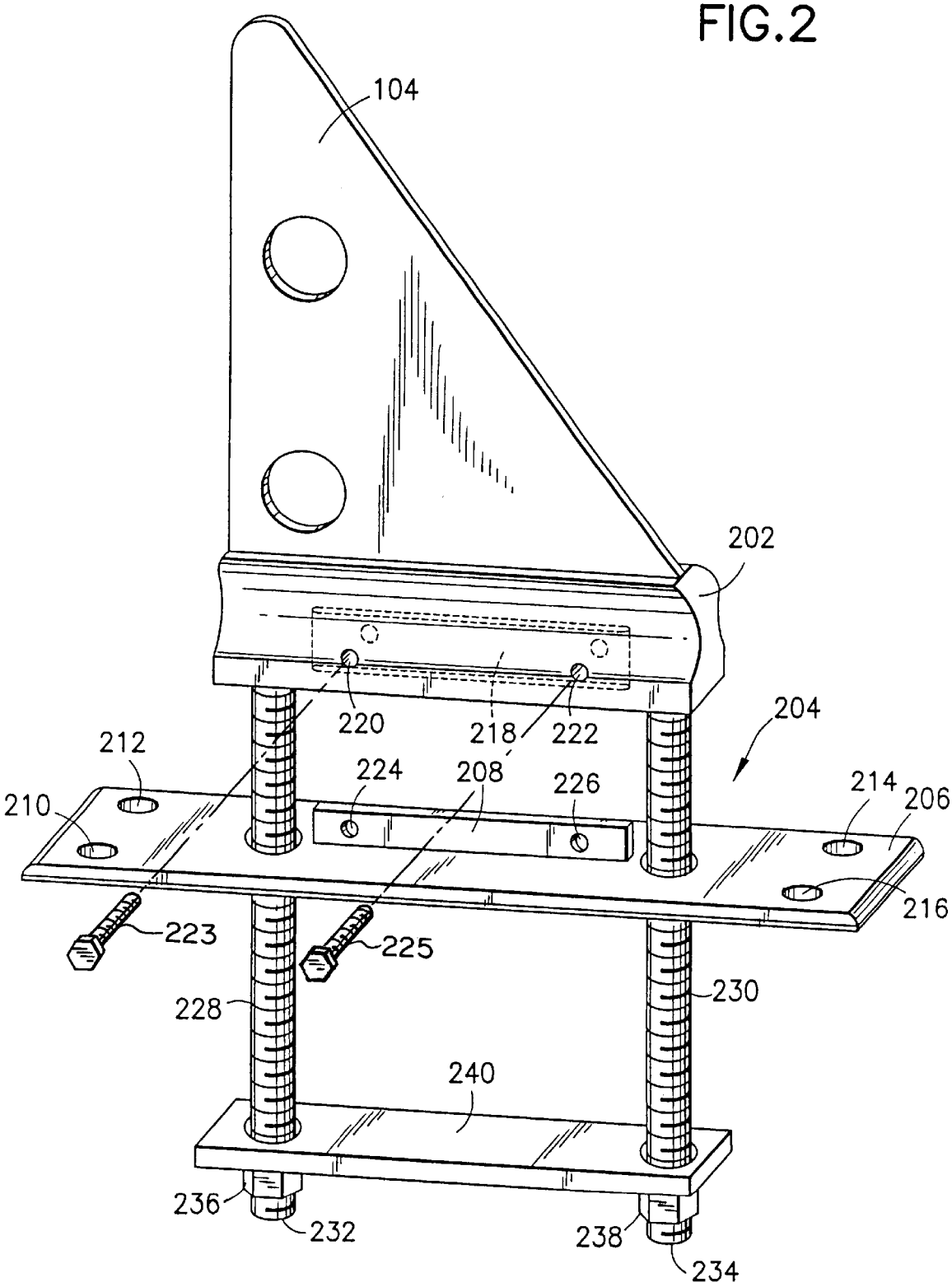
FIG. 2 is an exploded isometric view of a preferred embodiment of the present invention shown in FIG. 1.
Figure 3:
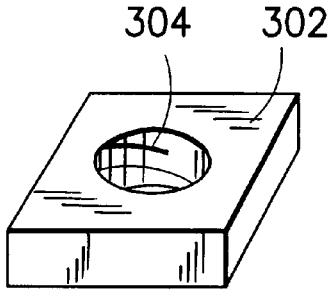
FIG. 3 is an isometric view of an alternative embodiment of a securement device shown in FIG. 2.

Turning now to FIG. 2, a preferred embodiment of the present invention is illustrated. In the preferred embodiment, block 202 is locatable on mounting bracket 204, which comprises plate 206 and plate 208 mounted substantially perpendicular thereto. Plates 206 and 208 can be secured together by weld or other conventional method. In the preferred embodiment, plate 206 is integral with plate 208 and cast as a single unit therewith.

The base of block 202 preferably comprises groove 218 located therein, and block 202 is preferably secured to mounting bracket 204 via placing groove 218 over plate 208. In the preferred embodiment, holes 220 and 222 in the block align with holes 224 and 226, respectively, when the block is placed on the mounting bracket.

Alternatively, where the present invention is used in conjunction with a membrane roof, the holes can be offset, requiring a downward pressure to be exerted on the block to align the holes, as described in detail with reference to US Pat. No. 5,613,328 to Alley.

Holes 220, 222 and/or 224, 226 can be threaded to receive bolts 223, 225 therethrough, thereby securely attaching the block to the mounting bracket. Alternatively, screws, pins, cotter pins and/or bolts and nuts may be located therethrough to securely attach the block to the mounting bracket. pins, cotter pins and/or bolts and nuts may be located therethrough to securely attach the block to the mounting bracket.

In the preferred embodiment, the approximate dimensions are as follows: block 202, 6"×2"×0.25"; plate 206, 10.5"×3.5"×0.25"; plate 208, 4"×0.75"×0.25"; the center of holes 210, 212 (214, 216) are located about 0.75" from the edge of plate 206; and the center of holes 220,222 (224,226) are located about 3" apart from each other.

The dimensions of plate 206 are preferably larger than the dimensions of the base of block 202, thereby increasing the effective contact area and decreasing the effective pressure of the block on the outer layer of the roof. However, it is to be understood that the dimensions of plate 206 can be equal to, less than or greater than the dimensions of the base of block 202.

Rods 228 and 230 are securely attached to block 202, preferably to the base thereof. In the preferred embodiment, rods 228 and 230 are threaded rods, and the base of block 202 comprises two holes having internal threads to receive rods 228 and 230.

In use, i.e., to secure the block to the roof, two holes are drilled or otherwise made in the roof through outer layer 114 and substrate layer 116 (FIG. 1). The two holes are preferably located and of sufficient diameter to accommodate rods 228 and 230.

Block 202 is preferably placed on mounting bracket 204, with plate 208 residing within groove 218 and secured thereto via screws located through holes 220, 224 and 222, 226 as discussed above.

The block and mounting bracket assembly are placed on the outer layer of the roof such that rods 228 and 230 are placed within the holes of the roof. The length of rods 228 and 230 is preferable sufficient to allow at least a portion of the rods, i.e., terminal ends 232 and 234 thereof, to extend below the substrate layer of the roof.

The block and mounting bracket assembly are preferably secured to the outer layer of the roof via securement devices 236 and 238 located about the portion of the rods extending below the substrate layer of the roof.

The securement device can comprise a hex nut, wing nut, acorn nut, or any other structure having internal threads capable of being threaded about the rods. In the preferred embodiment, the securement devices are hex nuts. Alternatively, with reference to FIG. 3, the securement device can comprise plate 302 having a hole with internal threads 304 therein. Other alternatives will be obvious to those skilled in the art.

In the preferred embodiment, lock plate 240 is located between the substrate layer and the securement devices. Lock plate 240 preferably comprises a single plate having two holes therein to accommodate rods 228 and 230.

Alternatively, the lock plate can comprise any structure having holes to accommodate the rods, or a pair of structures each having a hole to accommodate the rods independently.

Figure 4:
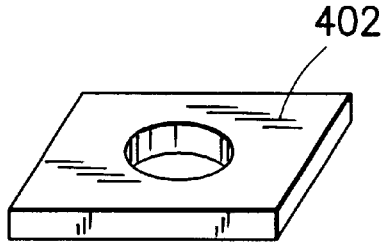
FIG. 4 is an isometric view of an alternative embodiment of the lock plate shown in FIG. 2.
Figure 5:
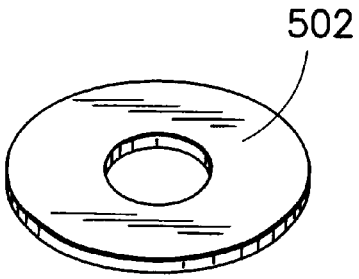
FIG. 5 is an isometric view of an alternative embodiment of the lock plate shown in FIG. 4.

For example, with reference to FIGS. 4 and 5, the lock plate can comprise square structure 402 (FIG. 4) or round structure 502 (FIG. 5) to independently accommodate rod 228 or 230. Other configurations for the lock plate will be obvious to those skilled in the art.

Once the block has been secured to the outer layer of the roof via the securement devices, the mounting bracket is preferably secured to the substrate layer of the roof via four screws (not shown) located in holes 210–216, respectively. The screws are preferably driven into the substrate layer and more preferably into a wood rafter (not shown) located under and supporting the substrate layer of the roof.

In the preferred embodiment, the approximate dimensions are as follows: rods 228, 230, ½" diameter, length to vary with thickness of roof; securement devices 236, 238, ½" nuts; and lock plate 240, 6"×2"×0.25".

The width of lock plate 240 (402, 502) is preferably greater than the width of the securement devices, thereby increasing the effective contact area of the securement devices to the substrate layer, as well as providing a safety factor in the event the diameter of the holes in the roof is greater than the width of the securement device.

While lock plate 240 (402, 502) is preferably located between the substrate layer of the roof and the securement devices, it is to be understood that securement devices 236 and 238 can be located directly on the substrate layer, without a lock plate therebetween.

Additionally, while mounting bracket 204 is preferably located between the outer layer of the roof and the base of block 202, it is to be understood that block 202 can be located directly on the outer layer of the roof, without mounting bracket 204 therebetween.

Figure 6:
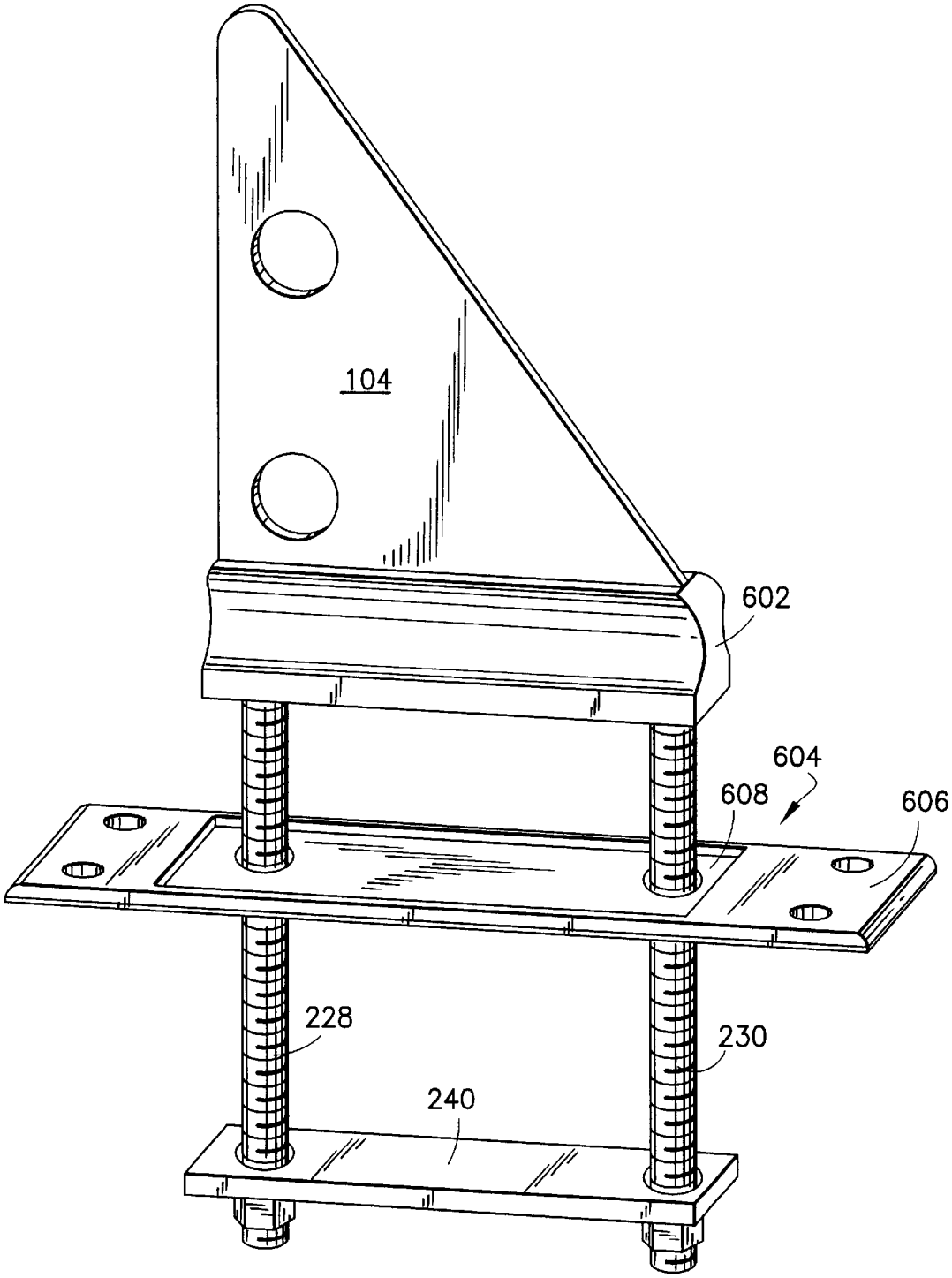
FIG. 6 is an exploded isometric view of the present invention, with snow guard attached thereto, illustrating an alternative embodiment of the block and mounting bracket shown in FIG. 2.

Turning now to FIG. 6, an alternative embodiment of block 202 and mounting bracket 204, shown in FIG. 2, is illustrated. In this embodiment, mounting bracket 604 preferably comprises plate 606 onto which the base of block 602 is locatable.

Mounting bracket 604 could simply comprise plate 606. However, in the preferred embodiment, mounting bracket 604 further comprises recessed area 608 into which the base of block 602 is locatable.

Recessed area 608 is preferably milled to a depth of about ⅛", and the length and width thereof are preferably substantially equal to the dimensions of the base of block 602, thereby providing a relatively close fit therebetween.

Figure 7:
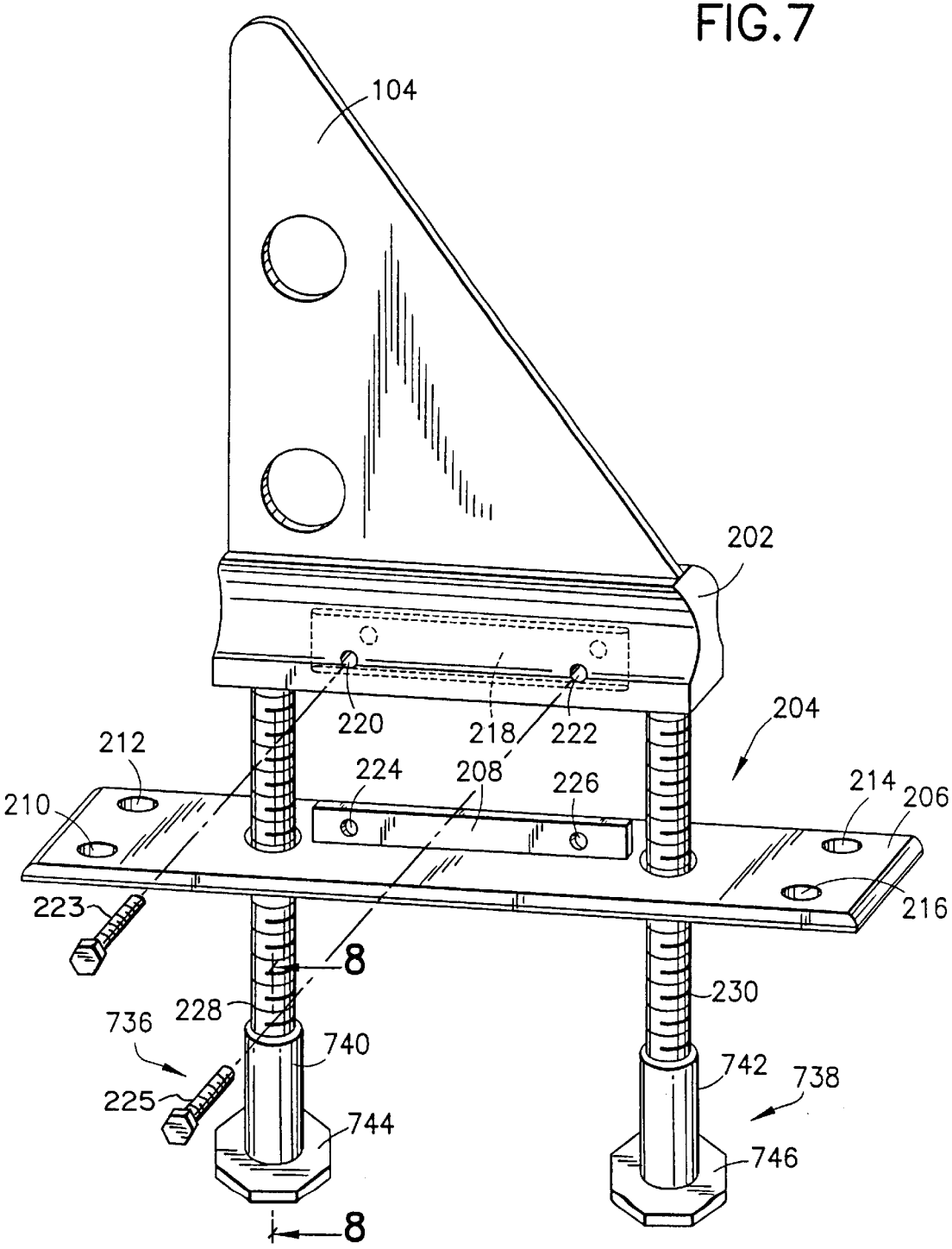
FIG. 7 is an exploded isometric view of another embodiment of the present invention with snow guard attached thereto.

Turning now to FIG. 7, another embodiment for securing the block to the roof to withstand substantial loads placed on the snow guard, thereby minimizing the possibility of the snow guard being torn off the roof, is illustrated.

In this embodiment, the terminal ends of the rods do not extend below the substrate layer of the roof when block 202 and mounting bracket 204 are located on the outer layer of the roof. Rather, the terminal ends of the rods are located within the holes of the roof. The block is preferably secured to the roof via securement devices 736 and 738 attached to the terminal ends of rods 228 and 230, respectively.

Specifically, securement devices 736 and 738 preferably comprise substantially tubular structures 740 and 742 and end caps 744 and 746. The outer diameter of tubular structures 740 and 742 preferably is less than the diameter of the holes of the roof, thereby allowing the tubular structure portion of each securement device to fit therewithin.

The outer perimeter of end caps 744 and 746 is preferably hexagonal to allow the securement devices to be tightened and/or loosened about the terminal ends of the rods via an adjustable, box or other suitable wrench (not shown) applied thereto.

The outer dimensions of end caps 744 and 746 are preferably greater than the diameter of the holes in the roof, thereby maintaining the end caps below the substrate layer of the roof when the block is secured to the outer layer of the roof.

In the preferred embodiment, the size of the outer dimensions of the end caps obviates the need for a lock plate (240, FIG. 2; 402, FIG. 4; 502, FIG. 5). However, a lock plate may optionally be located between the substrate layer and the end caps.

Figure 8:
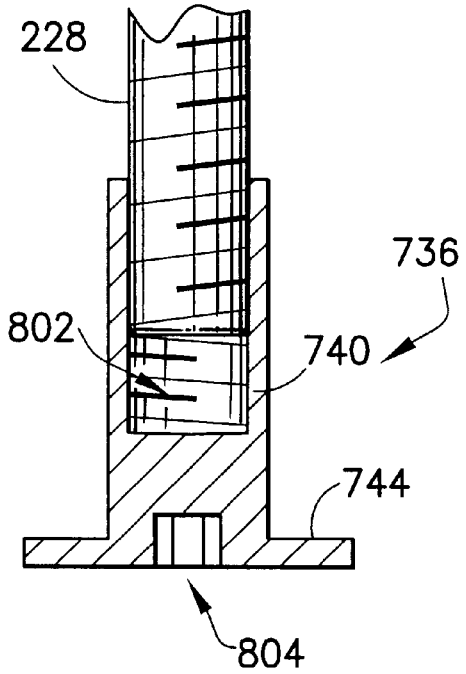
FIG. 8 is a cross-sectional view of the securement device shown in FIG. 7 taken along lines 8—8.

With reference to FIG. 8, a cross-sectional view of securement device 736, taken at lines 8—8, is illustrated. Tubular structure 740 (742) preferably comprises internal threads 802 which are threadable about the terminal end of rod 228 (230).

End cap 744 (746) optionally also comprises hole 804, preferably located within the center of the securement device. The internal shape of hole 804 is preferably configured to receive an allen wrench, screwdriver having a standard, Phillips, Robertson or other suitable tip, or other suitable driver (not shown) to allow the securement device to be tightened and/or loosened about the terminal end of the rod.

In the event the end caps do not contact the underside of the substrate layer when the securement devices are fully screwed about the rods, washers or other filler devices (not shown) are preferably placed therebetween to take up the slack and provide a tight fit therebetween.

The end caps of the securement devices may be exposed to a viewer, e.g., when the device is attached to a roof located above a cathedral ceiling. Thus, the base of the end caps can optionally be shaped in a geometric pattern or other ornamental shape, e.g., a fleur-delis or other flower, a leaf or animal. Alternatively, the ornamental shapes could be attached to the base of the end caps after installation.

Figure 9:
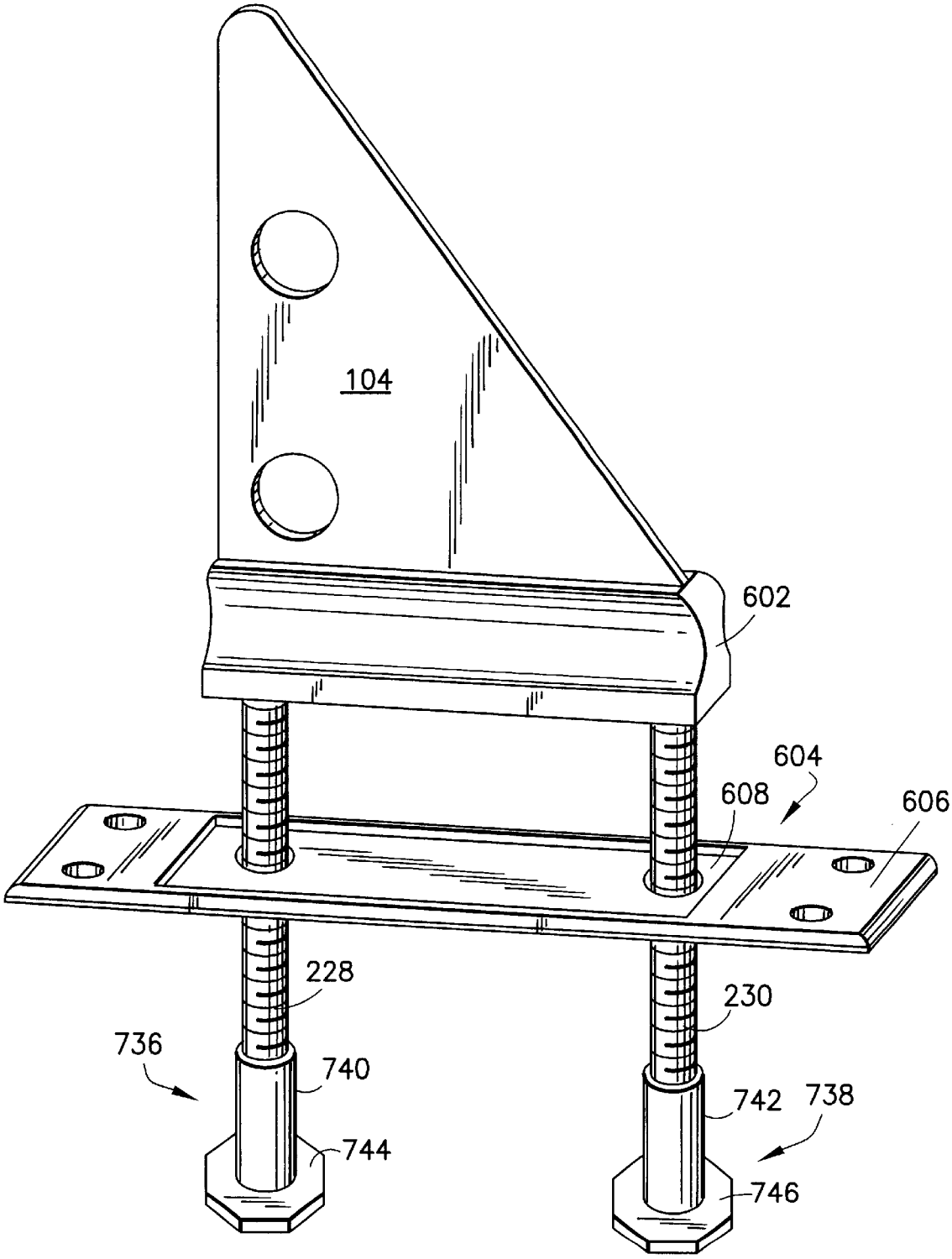
FIG. 9 is an exploded isometric view of the present invention, with snow guard attached thereto, illustrating an alternative embodiment of the block and mounting bracket shown in FIG. 7.

Turning now to FIG. 9, an alternative embodiment of block 202 and mounting bracket 204, shown in FIG. 7, is illustrated. In this embodiment, mounting bracket 604 preferably comprises plate 606 onto which the base of block 602 is locatable.

Mounting bracket 604 could simply comprise plate 606. However, in the preferred embodiment, mounting bracket 604 further comprises recessed area 608 into which the base of block 602 is locatable. The dimensions of recessed area 608 are preferably substantially equal to the dimensions of the base of block 602, thereby providing a relatively close fit therebetween.

In the embodiments discussed hereinabove, aluminum is the preferred material. Alternatively, steel, high-impact plastic or other suitable material or composition could be employed. Additionally, it is to be understood that all dimensions are approximate, and that other dimensions could be employed.

Although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

What I claim as my invention is:

1. A device to secure a snow guard to a roof having an outer layer attached to a substrate layer, the roof capable of having a first and a second hole located therethrough, the device comprising:

a block having a first and a second side wall, a base and a top, wherein the base of the block is locatable in juxtaposition with the outer layer of the roof;

the snow guard operatively attached to the block;

a first rod having a first and a second terminal end and a predetermined length therebetween, the first terminal end of the first rod operatively attached to the block, the second terminal end thereof being locatable through the first hole in the roof when the base of the block is located in juxtaposition with the outer layer of the roof;

a first securement device locatable on the first rod to secure the second terminal end of the first rod below the substrate layer of the roof, relative to the outer layer of the roof, when the base of the block is located in juxtaposition with the outer layer of the roof;

a second rod having a first and a second terminal end and a predetermined length therebetween, the first terminal end of the second rod operatively attached to the block, the second terminal end thereof being locatable through the second hole in the roof when the base of the block is located in juxtaposition with the outer layer of the roof; and a second securement device locatable on the second rod to secure the second terminal end of the second rod below the substrate layer of the roof, relative to the outer layer of the roof, when the base of the block is located in juxtaposition with the outer layer of the roof.

2. The device of claim 1, wherein:

the first rod further comprises a threaded portion located near the second terminal end thereof;

the first securement device comprises a structure having internal threads threadable about the threaded portion of the first rod;

the second rod further comprises a threaded portion located near the second terminal end thereof; and the second securement device comprises a structure having internal threads threadable about the threaded portion of the second rod.

3. The device of claim 1, wherein the device further comprises a lock plate having a base and a top surface, and a first and a second hole located therethrough, wherein a portion of the first and second rods are locatable within the first and second holes of the lock plate, respectively, and wherein the lock plate is locatable between the substrate layer of the roof and the first and second securement devices when the base of the block is located in juxtaposition with the outer layer of the roof.

4. The device of claim 1, wherein the device further comprises a first lock plate having a base and a top surface and a hole located therethrough, wherein a portion of the first rod is locatable within the hole of the first lock plate, and wherein the first lock plate is locatable between the substrate layer of the roof and the first securement device when the base of the block is located in juxtaposition with the outer layer of the roof.

5. The device of claim 4, wherein the device further comprises a second lock plate having a base and a top surface and a hole located therethrough, wherein a portion of the second rod is locatable within the hole of the second lock plate, and wherein the second lock plate is locatable between the substrate layer of the roof and the second securement device when the base of the block is located in juxtaposition with the outer layer of the roof.

6. The device of claim 1, wherein the device further comprises:

a mounting bracket comprising a first plate having a first and a second hole located therethrough and a second plate attached to the first plate and substantially perpendicular thereto; and a groove located in the base of the block, wherein the second plate of the mounting bracket is locatable within the groove of the block, a portion of the first and second rods are locatable within the first and second holes of the first plate, respectively, and the first plate of the mounting bracket is positionable between the base of the block and the outer layer of the roof when the base of the block is located in juxtaposition with the outer layer of the roof.

7. The device of claim 6, wherein the second plate of the mounting bracket comprises a hole therethrough, the block further comprises a first hole located between the first side wall and the groove and a second hole located between the second side wall and the groove, and the device further comprises:

an attachment device locatable within the first hole of the block, the hole located through the second plate of the mounting bracket and the second hole of the block to securely attach the block to the mounting bracket.

8. The device of claim 1, said device further comprising:

a mounting bracket having a base and a top surface, and a first and a second hole located therethrough, wherein a portion of the first and second rods are locatable within the first and second holes of the mounting bracket, respectively, and the mounting bracket is positionable between the base of the block and the outer layer of the roof when the base of the block is located in juxtaposition with the outer layer of the roof.

9. The device of claim 8, wherein the mounting bracket further comprises a recessed area located on a portion of the top surface thereof, wherein the base of the block is locatable within the recessed area.

10. A device to secure a snow guard to a roof having an outer layer attached to a substrate layer, the roof capable of having a first and a second hole located therethrough, the device comprising:

a block having a first and a second side wall, a base and a top;

the snow guard operatively attached to the block;

a mounting bracket comprising a first plate having a base and a top, and a first and a second hole located therethrough, wherein the base of the block is locatable on the top of the first plate and the base of the first plate is locatable in juxtaposition with the outer layer of the roof;

a first rod having a first and a second terminal end and a predetermined length therebetween, the first terminal end of the first rod operatively attached to the base of the block, wherein the second terminal end thereof is locatable through the first hole of the mounting bracket when the base of the block is located on the top of the first plate, and through the first hole of the roof when the base of the mounting bracket is located in juxtaposition with the outer layer of the roof;

a first securement device locatable on the first rod to secure the second terminal end of the first rod below the substrate layer of the roof, relative to the outer layer of the roof, when the base of the mounting bracket is located in juxtaposition with the outer layer of the roof;

a second rod having a first and a second terminal end and a predetermined length therebetween, the first terminal end of the second rod operatively attached to the base of the block, wherein the second terminal end thereof is locatable through the second hole of the mounting bracket when the base of the block is located on the top of the first plate, and through the second hole of the roof when the base of the mounting bracket is located in juxtaposition with the outer layer of the roof; and a second securement device locatable on the second rod to secure the second terminal end of the second rod below the substrate layer of the roof, relative to the outer layer of the roof, when the base of the mounting bracket is located in juxtaposition with the outer layer of the roof.

11. The device of claim 10, wherein the device further comprises:

a second plate attached to the first plate of the mounting bracket and substantially perpendicular thereto; and a groove located in the base of the block, wherein the second plate is locatable within the groove of the block.

12. The device of claim 11, wherein the second plate of the mounting bracket comprises a hole therethrough, the block further comprises a first hole located between the first side wall and the groove and a second hole located between the second side wall and the groove, and the device further comprises:

an attachment device locatable within the first hole of the block, the hole located through the second plate of the mounting bracket and the second hole of the block to securely attach the block to the mounting bracket.

13. The device of claim 10, wherein the first plate of the mounting bracket further comprises a recessed area located on a portion of the top thereof, wherein the base of the block is locatable within the recessed area.

14. The device of claim 10, wherein:

the first rod further comprises a threaded portion located near the second terminal end thereof;

the first securement device comprises a structure having internal threads threadable about the threaded portion of the first rod;

the second rod further comprises a threaded portion located near the second terminal end thereof; and the second securement device comprises a structure having internal threads threadable about the threaded portion of the second rod.

15. The device of claim 10, wherein the device further comprises a lock plate having a base and a top surface, and a first and a second hole located therethrough, wherein a portion of the first and second rods are locatable within the first and second holes of the lock plate, respectively, and wherein the lock plate is locatable between the substrate layer of the roof and the first and second securement devices when the base of the block is located on the top of the first plate of the mounting bracket and the base of the first plate is located in juxtaposition with the outer layer of the roof.

16. The device of claim 10, wherein the device further comprises a first lock plate having a base and a top surface and a hole located therethrough, wherein a portion of the first rod is locatable within the hole of the first lock plate, and wherein the first lock plate is locatable between the substrate layer of the roof and the first securement device when the base of the block is located on the top of the first plate of the mounting bracket and the base of the first plate is located in juxtaposition with the outer layer of the roof.

17. The device of claim 16, wherein the device further comprises a second lock plate having a base and a top surface and a hole located therethrough, wherein a portion of the second rod is locatable within the hole of the second lock plate, and wherein the second lock plate is locatable between the substrate layer of the roof and the second securement device when the base of the block is located on the top of the first plate of the mounting bracket and the base of the first plate is located in juxtaposition with the outer layer of the roof.

18. A device to secure a snow guard to a roof having an outer layer attached to a substrate layer, the roof capable of having a first and a second hole located therethrough, the device comprising:

a block having a first and a second side wall, a base and a top, wherein the base of the block is locatable in juxtaposition with the outer layer of the roof;

the snow guard operatively attached to the block;

a first rod having a first and a second terminal end and a predetermined length therebetween, the first terminal end of the first rod operatively attached to the block, the second terminal end thereof being locatable within the first hole of the roof when the base of the block is located in juxtaposition with the outer layer of the roof;

a first securement device locatable on the first rod to secure the second terminal end of the first rod within the first hole of the roof when the base of the block is located in juxtaposition with the outer layer of the roof;

a second rod having a first and a second terminal end and a predetermined length therebetween, the first terminal end of the second rod operatively attached to the block, the second terminal end thereof being locatable within the second hole of the roof when the base of the block is located in juxtaposition with the outer layer of the roof; and a second securement device locatable on the second rod to secure the second terminal end of the second rod within the second hole of the roof when the base of the block is located in juxtaposition with the outer layer of the roof.

19. The device of claim 18, wherein:

the first rod further comprises a threaded portion located near the second terminal end thereof;

the first securement device comprises a substantially tubular structure having a first and a second terminal end, internal threads located within at least a portion of the tubular structure and an end cap secured to the first terminal end, wherein the second terminal end of the tubular structure is locatable within the first hole of the roof, and wherein at least a portion of the internal threads thereof are threadable about at least a portion of the threaded portion of the first rod, the end cap thereof being located under the substrate layer, relative to the outer layer of the roof, when the base of the block is located in juxtaposition with the outer layer of the roof;

the second rod further comprises a threaded portion located near the second terminal end thereof; and the second securement device comprises a substantially tubular structure having a first and a second terminal end, internal threads located within at least a portion of the tubular structure and an end cap secured to the first terminal end, wherein the second terminal end of the tubular structure is locatable within the second hole of the roof, and wherein at least a portion of the internal threads thereof are threadable about at least a portion of the threaded portion of the second rod, the end cap thereof being located under the substrate layer, relative to the outer layer of the roof, when the base of the block is located in juxtaposition with the outer layer of the roof.

20. The device of claim 19, wherein the device further comprises a lock plate having a base and a top surface, and a first and a second hole located therethrough, wherein a portion of the first and second securement devices are locatable within the first and second holes of the lock plate, respectively, and wherein the lock plate is locatable between the substrate layer of the roof and the end caps of the first and second securement devices when the base of the block is located in juxtaposition with the outer layer of the roof.

21. The device of claim 19, wherein the device further comprises a first lock plate having a base and a top surface and a hole located therethrough, wherein a portion of the first securement device is locatable within the hole of the first lock plate, and wherein the first lock plate is locatable between the substrate layer of the roof and the end cap of the first securement device when the base of the block is located in juxtaposition with the outer layer of the roof.

22. The device of claim 21, wherein the device further comprises a second lock plate having a base and a top surface and a hole located therethrough, wherein a portion of the second securement device is locatable within the hole of the second lock plate, and wherein the second lock plate is locatable between the substrate layer of the roof and the end cap of the second securement device when the base of the block is located in juxtaposition with the outer layer of the roof.

23. The device of claim 18, wherein the device further comprises:

a mounting bracket comprising a first plate having a first and a second hole located therethrough and a second plate attached to the first plate and substantially perpendicular thereto; and a groove located in the base of the block, wherein the second plate of the mounting bracket is locatable within the groove of the block, a portion of the first and second rods are locatable within the first and second holes of the first plate, respectively, and the first plate of the mounting bracket is positionable between the base of the block and the outer layer of the roof when the base of the block is located in juxtaposition with the outer layer of the roof.

24. The device of claim 23, wherein the second plate of the mounting bracket comprises a hole therethrough, the block further comprises a first hole located between the first side wall and the groove and a second hole located between the second side wall and the groove, and the device further comprises:

an attachment device locatable within the first hole of the block, the hole located through the second plate of the mounting bracket and the second hole of the block to securely attach the block to the mounting bracket.

25. The device of claim 18, said device further comprising:

a mounting bracket having a base and a top surface, and a first and a second hole located therethrough, wherein a portion of the first and second rods are locatable within the first and second holes of the mounting bracket, respectively, and the mounting bracket is positionable between the base of the block and the outer layer of the roof when the base of the block is located in juxtaposition with the outer layer of the roof.

26. The device of claim 25, wherein the mounting bracket further comprises a recessed area located on a portion of the top surface thereof, wherein the base of the block is locatable within the recessed area.

27. A device to secure a snow guard to a roof having an outer layer attached to a substrate layer, the roof capable of having a first and a second hole located therethrough, the device comprising:

a block having a first and a second side wall, a base and a top;

the snow guard operatively attached to the block;

a mounting bracket comprising a first plate having a base and a top, and a first and a second hole located therethrough, wherein the base of the block is locatable on the top of the first plate and the base of the first plate is locatable in juxtaposition with the outer layer of the roof;

a first rod having a first and a second terminal end and a predetermined length therebetween, the first terminal end of the first rod operatively attached to the base of the block, wherein the second terminal end of the first rod is locatable through the first hole of the mounting bracket when the base of the block is located on the top of the first plate, and within the first hole of the roof when the base of the first plate is located in juxtaposition with the outer layer of the roof;

a first securement device locatable on the first rod to secure the second terminal end of the first rod within the first hole of the roof when the base of the block is located on the top of the first plate and the base of the first plate is located in juxtaposition with the outer layer of the roof;

a second rod having a first and a second terminal end and a predetermined length therebetween, the first terminal end of the second rod operatively attached to the base of the block, wherein the second terminal end of the second rod is locatable through the second hole of the mounting bracket when the base of the block is located on the top of the first plate, and within the second hole of the roof when the base of the first plate is located in juxtaposition with the outer layer of the roof; and a second securement device locatable on the second rod to secure the second terminal end of the second rod within the second hole of the roof when the base of the block is located on the top of the first plate and the base of the first plate is located in juxtaposition with the outer layer of the roof.

28. The device of claim 27, wherein the device further comprises:

a second plate attached to the first plate of the mounting bracket and substantially perpendicular thereto; and a groove located in the base of the block, wherein the second plate is locatable within the groove of the block.

29. The device of claim 28, wherein the second plate of the mounting bracket comprises a hole therethrough, the block further comprises a first hole located between the first side wall and the groove and a second hole located between the second side wall and the groove, and the device further comprises:

an attachment device locatable within the first hole of the block, the hole located through the second plate of the mounting bracket and the second hole of the block to securely attach the block to the mounting bracket.

30. The device of claim 27, wherein the first plate of the mounting bracket further comprises a recessed area located on a portion of the top thereof, wherein the base of the block is locatable within the recessed area.

31. The device of claim 27, wherein:

the first rod further comprises a threaded portion located near the second terminal end thereof;

the first securement device comprises a substantially tubular structure having a first and a second terminal end, internal threads located within at least a portion of the tubular structure and an end cap secured to the first terminal end, wherein the second terminal end of the tubular structure is locatable within the first hole of the roof, and wherein at least a portion of the internal threads thereof are threadable about at least a portion of the threaded portion of the first rod, the end cap thereof being located under the substrate layer, relative to the outer layer of the roof, when the base of the block is located on the top of the first plate and the base of the first plate is located in juxtaposition with the outer layer of the roof;

the second rod further comprises a threaded portion located near the second terminal end thereof; and the second securement device comprises a substantially tubular structure having a first and a second terminal end, internal threads located within at least a portion of the tubular structure and an end cap secured to the second terminal end, wherein the second terminal end of the tubular structure is locatable within the second hole of the roof, and wherein at least a portion of the internal threads thereof are threadable about at least a portion of the threaded portion of the second rod, the end cap thereof being located under the substrate layer, relative to the outer layer of the roof, when the base of the block is located on the top of the first plate and the base of the first plate is located in juxtaposition with the outer layer of the roof.

32. The device of claim 31, wherein the device further comprises a lock plate having a base and a top surface, and a first and a second hole located therethrough, wherein a portion of the first and second securement devices are locatable within the first and second holes of the lock plate, respectively, and wherein the lock plate is locatable between the substrate layer of the roof and the end caps of the first and second securement devices when the base of the block is located on the top of the first plate and the base of the first plate is located in juxtaposition with the outer layer of the roof.

33. The device of claim 31, wherein the device further comprises a first lock plate having a base and a top surface and a hole located therethrough, wherein a portion of the first securement device is locatable within the hole of the first lock plate, and wherein the first lock plate is locatable between the substrate layer of the roof and the end cap of the first securement device when the base of the block is located on the top of the first plate and the base of the first plate is located in juxtaposition with the outer layer of the roof.

34. The device of claim 33, wherein the device further comprises a second lock plate having a base and a top surface and a hole located therethrough, wherein a portion of the second securement device is locatable within the hole of the second lock plate, and wherein the second lock plate is locatable between the substrate layer of the roof and the end cap of the second securement device when the base of the block is located on the top of the first plate and the base of the first plate is located in juxtaposition with the outer layer of the roof.

35. A device to secure a snow guard to a roof having an outer layer attached to a substantially rigid substrate layer, the roof capable of having at least a first hole located therethrough, the device comprising:

an upper structure locatable in juxtaposition with the outer layer of the roof;

the snow guard operatively attached to the upper structure;

a lower structure locatable below the substantially rigid substrate layer of the roof, relative to the outer layer of the roof, and locatable in juxtaposition with the substrate layer of the roof; and a connector locatable within the hole in the roof, the connector to operatively connect the upper structure to the lower structure through the hole in the roof.

36. The device of claim 35, wherein the upper structure comprises a block having a first and a second side wall, a base and a top, the base of the block locatable in juxtaposition with the outer layer of the roof;

wherein the connector comprises a rod having a first and a second terminal end and a predetermined length therebetween, the first terminal end of the rod operatively attached to the block, the second terminal end thereof being locatable through the hole in the roof when the base of the block is located in juxtaposition with the outer layer of the roof; and wherein the lower structure comprises a securement device locatable on the rod to secure the second terminal end of the rod below the substrate layer of the roof, relative to the outer layer of the roof, when the base of the block is located in juxtaposition with the outer layer of the roof.

37. The device of claim 36, wherein:

the rod further comprises a threaded portion located near the second terminal end thereof; and the securement device comprises a body having internal threads threadable about the threaded portion of the rod.

38. The device of claim 36, wherein the lower structure further comprises a lock plate having a base and a top surface and a hole located therethrough, wherein a portion of the rod is locatable within the hole of the lock plate, and wherein the lock plate is locatable between the substrate layer of the roof and the securement device when the base of the block is located in juxtaposition with the outer layer of the roof.

39. The device of claim 36, wherein the upper structure further comprises:

a mounting bracket comprising a first plate having a hole located therethrough and a second plate attached to the first plate and substantially perpendicular thereto; and a groove located in the base of the block, wherein the second plate of the mounting bracket is locatable within the groove of the block, a portion of the rod is locatable within the hole of the first plate, and the first plate of the mounting bracket is positionable between the base of the block and the outer layer of the roof when the base of the block is located in juxtaposition with the outer layer of the roof.

40. The device of claim 39, wherein the second plate of the mounting bracket comprises a hole therethrough, the block further comprises a first hole located between the first side wall and the groove and a second hole located between the second side wall and the groove, and the upper structure further comprises:

an attachment device locatable within the first hole of the block, the hole located through the second plate of the mounting bracket and the second hole of the block to securely attach the block to the mounting bracket.

41. The device of claim 36, wherein the upper structure further comprises:

a mounting bracket having a base and a top surface, and a hole located therethrough, wherein a portion of the rod is locatable within the hole of the mounting bracket, and the mounting bracket is positionable between the base of the block and the outer layer of the roof when the base of the block is located in juxtaposition with the outer layer of the roof.

42. The device of claim 41, wherein the mounting bracket further comprises a recessed area located on a portion of the top surface thereof, wherein the base of the block is locatable within the recessed area.

43. The device of claim 35, wherein the upper structure comprises a block having a first and a second side wall, a base and a top, the base of the block locatable in juxtaposition with the outer layer of the roof;

wherein the connector comprises a rod having a first and a second terminal end and a predetermined length therebetween, the first terminal end of the rod operatively attached to the block, the second terminal end thereof being locatable within the hole in the roof when the base of the block is located in juxtaposition with the outer layer of the roof; and wherein the lower structure comprises a securement device locatable on the rod to secure the second terminal end of the rod within the hole of the roof when the base of the block is located in juxtaposition with the outer layer of the roof.

44. The device of claim 43, wherein:

the rod further comprises a threaded portion located near the second terminal end thereof; and the securement device comprises a substantially tubular structure having a first and a second terminal end, internal threads located within at least a portion of the tubular structure and an end cap secured to the first terminal end, wherein the second terminal end of the tubular structure is locatable within the hole of the roof, and wherein at least a portion of the internal threads thereof are threadable about at least a portion of the threaded portion of the rod, the end cap thereof being located under the substrate layer, relative to the outer layer of the roof, when the base of the block is located in juxtaposition with the outer layer of the roof.

45. The device of claim 43, wherein the lower structure further comprises a lock plate having a base and a top surface and a hole located therethrough, wherein a portion of the securement device is locatable within the hole of the lock plate, and wherein the lock plate is locatable between the substrate layer of the roof and the end cap of the securement device when the base of the block is located in juxtaposition with the outer layer of the roof.

46. The device of claim 43, wherein the upper structure further comprises:

a mounting bracket comprising a first plate having a hole located therethrough and a second plate attached to the first plate and substantially perpendicular thereto; and a groove located in the base of the block, wherein the second plate of the mounting bracket is locatable within the groove of the block, a portion of the rod is locatable within the hole of the first plate, and the first plate of the mounting bracket is positionable between the base of the block and the outer layer of the roof when the base of the block is located in juxtaposition with the outer layer of the roof.

47. The device of claim 46, wherein the second plate of the mounting bracket comprises a hole therethrough, the block further comprises a first hole located between the first side wall and the groove and a second hole located between the second side wall and the groove, and the upper structure further comprises:

an attachment device locatable within the first hole of the block, the hole located through the second plate of the mounting bracket and the second hole of the block to securely attach the block to the mounting bracket.

48. The device of claim 43, wherein the upper structure further comprising:

a mounting bracket having a base and a top surface, and a hole located therethrough, wherein a portion of the rod is locatable within the hole of the mounting bracket, and the mounting bracket is positionable between the base of the block and the outer layer of the roof when the base of the block is located in juxtaposition with the outer layer of the roof.

49. The device of claim 48, wherein the mounting bracket further comprises a recessed area located on a portion of the top surface thereof, wherein the base of the block is locatable within the recessed area.

* * * * *